US008594529B2

(12) United States Patent
Jeong

(10) Patent No.: US 8,594,529 B2
(45) Date of Patent: Nov. 26, 2013

(54) TRANSFER UNIT ENGAGEMENT ASSEMBLY OF AN IMAGE FORMING APPARATUS

(75) Inventor: Gi-cheol Jeong, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 402 days.

(21) Appl. No.: 12/881,564

(22) Filed: Sep. 14, 2010

(65) Prior Publication Data

US 2011/0142497 A1 Jun. 16, 2011

(30) Foreign Application Priority Data

Dec. 16, 2009 (KR) ..... 10-2009-0125409

(51) Int. Cl.
*G03G 15/00* (2006.01)

(52) U.S. Cl.
USPC ..... 399/110; 399/120; 399/121; 399/360

(58) Field of Classification Search
USPC ..... 399/12, 110, 120, 121, 360
See application file for complete search history.

(56) References Cited

U.S. PATENT DOCUMENTS

2003/0072584 A1* 4/2003 Cho ..... 399/110
2004/0228653 A1* 11/2004 Yoshino ..... 399/121
2008/0118271 A1* 5/2008 Kim et al.
2009/0097879 A1* 4/2009 Nagashima et al. ..... 399/120

* cited by examiner

*Primary Examiner* — David Gray
*Assistant Examiner* — Laura Roth
(74) *Attorney, Agent, or Firm* — Stanzione & Kim, LLP

(57) ABSTRACT

An image forming apparatus includes a transfer unit detachably supported by a body frame to transfer an image on an image holding member to a recording medium. A driving unit installed on the body frame provides a rotational driving force to the transfer unit. A waste developing agent container is selectively attached to the body frame to store waste developing agent collected from the transfer unit. An engagement assembly is installed on the body frame to selectively engage the transfer unit with the driving unit to the transfer unit while at the same time allowing or blocking the installation of the waste developing agent container in the body frame in accordance with the state of engagement of the transfer unit.

21 Claims, 10 Drawing Sheets

TRANSFER UNIT ENGAGEMENT ASSEMBLY OF AN IMAGE FORMING APPARATUS

CROSS-REFERENCE TO RELATED APPLICATIONS

This application claims benefit of priority under Korean Patent Application No. 10-2009-0125409, filed on Dec. 16, 2009 in the Korean Intellectual Property Office, the disclosure of which is incorporated herein by reference.

BACKGROUND

1. Field of the Invention

The present general inventive concept is related to image forming apparatuses that include a transfer unit to form images on a recording medium by way of a developing agent and whose operation depends on installation of a predetermined component. More particularly, the present general inventive concept is directed to an image forming apparatus in which a driving force is selectively transferred to the transfer unit.

2. Description of the Related Art

An electrophotographic image forming apparatus transforms image data provided from an external host device into a visible image on a recording medium by applying a developing agent to the recording medium to correspond to the image data. The image forming apparatus typically includes a transfer unit to transfer the developing agent to the recording medium that ultimately forms the visible image. The transfer unit is detachably mounted in the image forming apparatus and is driven by a driving force provided by a driving unit when mounted in the image forming apparatus.

A typical transfer unit of an image forming apparatus is that of an intermediate type, in which an intermediate transfer belt is interposed between a latent image holding member and an intermediate transfer roller. Typically, a driving roller engages the intermediate transfer belt through friction and rotates the intermediate transfer belt thereby in an endless track mode. When the transfer unit is properly mounted in the image forming apparatus, the driving roller engages with a driving unit through which the driving force rotates the intermediate transfer belt.

In apparatuses where the transfer unit is detached in a direction perpendicular to the direction in which the driving roller engages with the driving unit, the driving roller is first disengaged from the driving unit prior to the transfer unit being removed. However, the subsequent mounting of the transfer unit must include re-engaging the driving unit so that a printing process may be carried out successfully.

If the printing process is attempted when the driving roller is disengaged from the driving unit, the intermediate transfer belt of the transfer unit fails to rotate, resulting in excessive friction between the surface of an image holding member and the intermediate transfer belt. Thus, the image holding member and the intermediate transfer belt are excessively worn and image quality on the printing medium is greatly diminished.

SUMMARY

Accordingly, one or more exemplary embodiments of the present general inventive concept provide an image forming apparatus that prohibits a printing process from being carried out in the state where a driving roller is not engaged with a driving unit.

The foregoing and/or other aspects may be achieved by providing an image forming apparatus including a body frame, an image holding member supported by the body frame to receive a developing agent, a transfer unit detachably supported by the body frame to transfer the developing agent on the image holding member to a recording medium, a driving unit disposed on the body frame to provide a driving force to the transfer unit, a waste developing agent container disposed on the body frame to store waste developing agent collected from the transfer unit and an engagement assembly to selectively engage with the transfer unit to transfer the driving force from the driving unit to the transfer unit and prohibiting or allowing installation of the waste developing agent container in the body frame in accordance with a state of engagement thereof with the transfer unit.

The engagement assembly may allow the transfer of the driving force to the transfer unit and the installation of the waste developing agent container when engaging with the transfer unit, and may block the transfer of the driving force to the transfer unit and the installation of the waste developing agent container when disengaging from the transfer unit.

The engagement assembly may include a lever the manipulation of which motivates the engagement assembly to engage with or disengage from the transfer unit and to selectively extend into a portion of the body frame on which the waste developing agent container is mounted so as to block installation of the waste developing agent container when the engagement assembly is disengaged.

The engagement assembly may include a coupling member operated by the lever between an engaging position at which the engagement assembly engages with the transfer unit supported by the body frame and a disengaging position at which the engagement assembly disengages from the transfer unit so as to allow removal of the transfer unit from the body frame.

The coupling member may move in a direction perpendicular to a surface of the body frame, and the transfer unit may be detached from the body frame in a direction perpendicular to the direction in which the coupling member moves.

The body frame may include a first body frame supporting one side of right and left sides of the transfer unit and on which the driving unit and the coupling unit are installed and a second body frame supporting the other side of the right and left sides of the transfer unit to face the first body frame and on which the waste developing agent container and the lever are installed.

The engagement assembly may include a link shaft extending between the first body frame and the second body frame through which the coupling member is motivated by the lever.

The body frame may include a first body frame and a second body frame supporting right and left sides of the transfer unit to face each other, respectively, and both of the driving unit and the waste developing agent container are mounted to one of the first body frame and the second body frame.

The engagement assembly may include a moving member coupled to the coupling member so as to linearly move the coupling member by rotation of the moving member, an accommodation groove formed on one side of the moving member, a link member to rotate in accordance with rotation of the lever, and a protrusion interposed between the moving member and engaging with the accommodation groove, whereby the moving member translates the rotation of the link member to linear motion of the coupling member by which the coupling member moves between the engaging position and the disengaging position.

The engagement assembly may include an elastic member elastically biasing the coupling member toward the engaging position.

The transfer unit may include an intermediate transfer belt in contact with the image holding member to receive a visible image from the image holding member, an intermediate transfer roller installed in facing opposition to the image holding member with the intermediate transfer belt being interposed therebetween, a final transfer roller to transfer the visible image transferred to the intermediate transfer belt to the recording medium; and a driving roller engaged with the engagement assembly to rotate the intermediate transfer belt by the driving force of the driving unit.

The foregoing and/or other aspects may also be achieved by providing an image forming apparatus including an interlocked component to inhibit a printing operation of the image forming apparatus if not properly positioned thereon, a transfer unit to receive a developing agent defining a visible image and applying the received developing agent to a recording medium, a driving unit to provide a driving force to transfer unit by which the developing agent is conveyed to the recording medium, and an engagement unit to selectively engage the transfer unit with, and disengage the transfer unit from the driving unit, the proper positioning of the interlocked component being prevented by the engagement unit when the transfer unit is disengaged from the driving unit.

The foregoing and/or other aspects may also be achieved by providing an image forming apparatus including a plurality of developing agent transferring units defining an image forming path over which an electrostatic latent image is developed into a visible image, a driving unit to drive the developing agent transferring units in accordance with a predetermined timing of operations performed thereby over the image forming path, an engagement unit to disengage one of the developing agent transfer units from the driving unit so as to allow removal thereof from the image forming apparatus, and an interlocked component to inhibit performance of at least one of the operations when positioned in other than an operating position, the engagement unit being operable to disengage the one of the developing agent transfer units from the driving unit only if the interlocked component is in the other than the operating position.

BRIEF DESCRIPTION OF THE DRAWINGS

The above and/or other aspects of the present general inventive concept will become apparent and more readily appreciated from the following description of exemplary embodiments when read in conjunction with the accompanying drawings, in which.

DETAILED DESCRIPTION OF THE EMBODIMENTS

Figure 1:
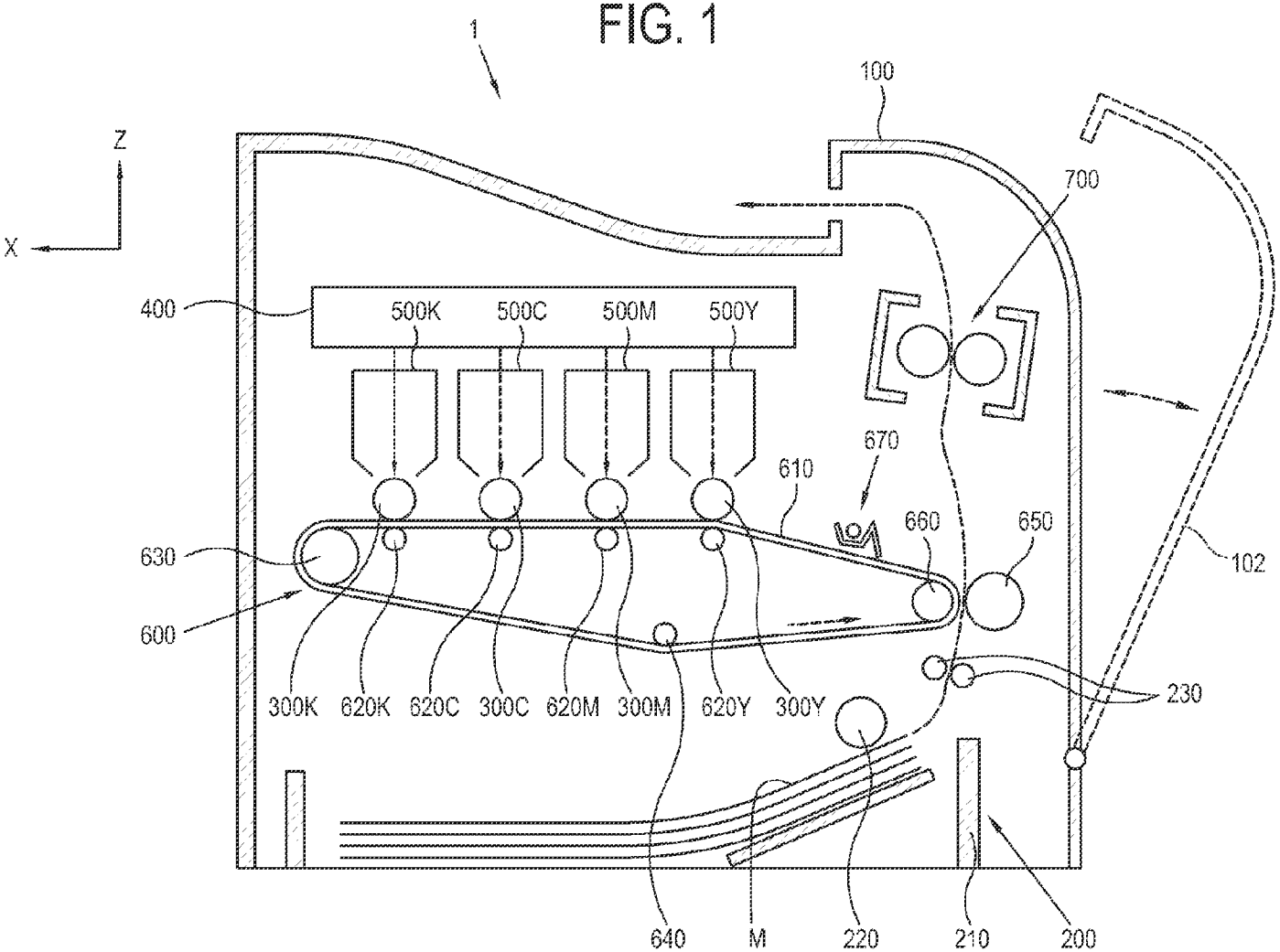
FIG. 1 is a lateral cross-sectional view of an image forming apparatus according to one exemplary embodiment of the present inventive concept.

Exemplary embodiments of the present general inventive concept will now be described in detail with reference to accompanying drawings, wherein like reference numeral refer to like elements throughout. The present general inventive concept may be embodied in various forms without being limited to the exemplary embodiments set forth herein. Descriptions of well-known parts may be omitted for clarity, however it is to be understood that lack of description of such components is not intended to imply that the components are unnecessary to construct the image forming apparatus 1 through which the present inventive concept is practiced.

FIG. 1 is a lateral cross-sectional view of an image forming apparatus 1 according to one exemplary embodiment of the present inventive concept. In forming an image, the image forming apparatus 1 of the illustrated embodiment transfers a developing agent to a recording medium (M) in an intermediate type transfer to produce a visible image. As is illustrated in FIG. 1, the direction in which the printing medium (M) is discharged from the image forming apparatus 1 and a direction in which a paper feeding cassette 210 is detached are perpendicular to each other.

As illustrated in FIG. 1, the image forming apparatus 1 of the illustrated embodiment includes a body housing 100 in which the functional components of the image forming apparatus 1 are contained, a paper feeding unit 200 holding a recording medium (M) and providing the recording medium (M) during a printing cycle, an image holding members 300Y, 300M, 300C, and 300K to retain an electrostatic latent image formed thereon from which a visible image is developed, an exposure unit 400 to irradiate the image holding members 300Y, 300M, 300C, and 300K thereby producing the electrostatic latent image, a developing unit 500Y, 500M, 500C, and 500K to distribute a developing agent across the electrostatic latent image on the corresponding image holding members 300Y, 300M, 300C, and 300K thereby producing the visible image, a transfer unit 600 to transfer the visible image on the image holding members 300Y, 300M, 300C, and 300K to the recording medium (M) in an intermediate type transfer, and a fixing unit 700 to affix the visible image onto the recording medium (M) by heat and pressure.

The paper feeding unit 200 includes the paper feeding cassette 210, which is detachable from the body housing 100, a pickup roller 220 to retrieve the recording medium (M) from the paper feeding cassette 210, and a registration roller 230 to convey the retrieved recording medium (M) to the transfer unit 600 per the timing of the print cycle.

The paper feeding cassette 210 is selectively separable from the body housing 100 and supplied with the recording medium (M). When a printing cycle is initiated, the pickup roller 220 retrieves recording medium (M) from the top of the paper feeding cassette 210 and conveys the retrieved medium (M) to the registration roller 230. The registration roller 230 aligns the edge of the recording medium (M) with the transfer unit 600 and conveys the recording medium into the transfer unit 600 at the arrival time of the developing agent therein, thereby transferring the developing agent onto the recording medium (M) to form the visible image.

The image holding members 300Y, 300M, 300C, and 300K correspond in number to the number of colors. In the exemplary embodiment of FIG. 1, the image holding members 300Y, 300M, 300C, and 300K correspond to four colors, respectively, i.e., yellow, magenta, cyan, and black.

The image holding members 300Y, 300M, 300C, and 300K are each irradiated by the exposure unit 400 such that an electrostatic latent image is formed thereon based on image data for the corresponding color. The developing agent is then distributed across the electrostatic latent image on the image holding members 300Y, 300M, 300C, and 300K and adheres thereto by a difference in electrostatic charge, thereby forming a visible image by the developing agent.

The exposure unit 400 radiates a light beam onto the image holding members 300Y, 300M, 300C, and 300K, each uniformly charged prior thereto, in accordance with the image data for each color to form the corresponding electrostatic latent image. The exposure unit 400 may be realized by a light scanning unit which includes a light source (not illustrated), a polygonal reflector (not illustrated), and a variety of optical lenses (not illustrated).

A plurality of developing units 500Y, 500M, 500C, and 500K are installed to correspond by color to the image holding members 300Y, 300M, 300C, and 300K, respectively. The developing units 500Y, 500M, 500C, and 500K store respective developing agents, each corresponding to the color of the image holding members 300Y, 300M, 300C, and 300K. For example, the developing units 500Y, 500M, 500C, and 500K store the developing agents of four colors, i.e., yellow, magenta, cyan, and black, respectively, and each distributes the developing agents to the electrostatic latent image on the corresponding image holding members 300Y, 300M, 300C, and 300K to form the visible image therein.

The developing units 500Y, 500M, 500C, and 500K may be realized by respective cartridges, each being selectively detachable from the body housing 100 so as to be replaced when the developing agent therein is expended.

The transfer unit 600 transfers the visible images of each color retained on image holding members 300Y, 300M, 300C, and 300K onto a suitable transfer medium in a manner by which all of the color images are properly registered, one on the other, to form a final composite image. Once this has been achieved, the transfer unit 600 transfers the intermediately transferred visible image to the recording medium (M). The transfer unit 600 may be detachable from within the body housing 100, through, for example, a cover 102 of the body housing 100 being opened.

Hereinafter, spatial relationships of various features of the exemplary embodiments will be described through an arbitrary set of directional axes. In the drawings, X, Y, and Z directions indicate the width, length, and height directions, respectively, and the opposite X, Y, and Z directions are expressed as −X, −Y, and −Z directions, respectively. In the exemplary embodiments described herein, it will be assumed that the X direction is the direction in which the transfer unit 600 is mounted into the body housing 100, the Y direction and Z direction being mutually orthogonal to the X direction and with one another. Accordingly, the XY-plane refers to a plane defined by the X-axis and the Y-axis.

The transfer unit 600 may include an intermediate transfer belt 610 implemented in an endless belt and coming in mutual contact with the image holding members 300Y, 300M, 300C, and 300K, a plurality of intermediate transfer rollers 620Y, 620M, 620C, and 620K installed in opposing relationship with the respective image holding members 300Y, 300M, 300C, and 300K with the intermediate transfer belt 610 being interposed therebetween, a driving roller 630 to apply a rotational force to the intermediate transfer belt 610, a tension roller 640 place the intermediate transfer belt 610 under suitable tension, a final transfer roller 650 installed in a conveyance path of the recording medium (M) at the exit of the registration roller 230 so as to contact the intermediate transfer belt 610, and a backup roller 660 to provide backing to the intermediate transfer belt 610 against the final transfer roller 650.

In FIG. 1, it is to be assumed that the driving roller 630 rotates in a counterclockwise direction, whereby the intermediate transfer rollers 620Y, 620M, 620C, and 620K transfer a visible image of the corresponding color onto the image holding members 300Y, 300M, 300C, and 300K and then onto the intermediate transfer belt 610. Here, visible images of yellow, magenta, cyan, and black are transferred sequentially onto the intermediate transfer belt 610 such that the individual images are properly registered, one on the other, on the intermediate transfer belt 610 to form into a final color image.

Once the final color image has been transferred onto the intermediate transfer belt 610, the recording medium (M) is conveyed by the registration roller 230 at a time by which, in correspondence to the speed of the intermediate transfer belt 610, the final image is properly positioned on the recording medium (M). The recording medium (M) is captured from the registration roller 230 by the final transfer roller 650, which transfers the final color image from the intermediate transfer belt 610 onto the recording medium (M).

In the transfer process, developing agent that is not transferred to the recording medium (M) may remain on the intermediate transfer belt 610 as waste, and thus the transfer unit 600 includes a waste developing agent collecting unit 670 to collect the waste developing agent.

The present general inventive concept is not limited to a particular implementation of the waste developing agent collecting unit 670. For example, the waste developing agent collecting unit 670 may collect waste developing agent that is removed from the intermediate transfer belt 610 by a blade (not illustrated) that spans the width of the intermediate transfer belt 610. The waste developing agent collecting unit 670 may include a channel (not illustrated), in which the waste developing agent is moved to a waste developing agent container 680, such as, for example, by an auger (not illustrated), where the waste developing agent is stored.

The fixing unit 700 applies heat and pressure to the recording medium (M) to which the final color image has been transferred to affix the final color image thereto. Once the fixing has been completed, the recording medium (M) is discharged from the body housing 100.

Figure 2:
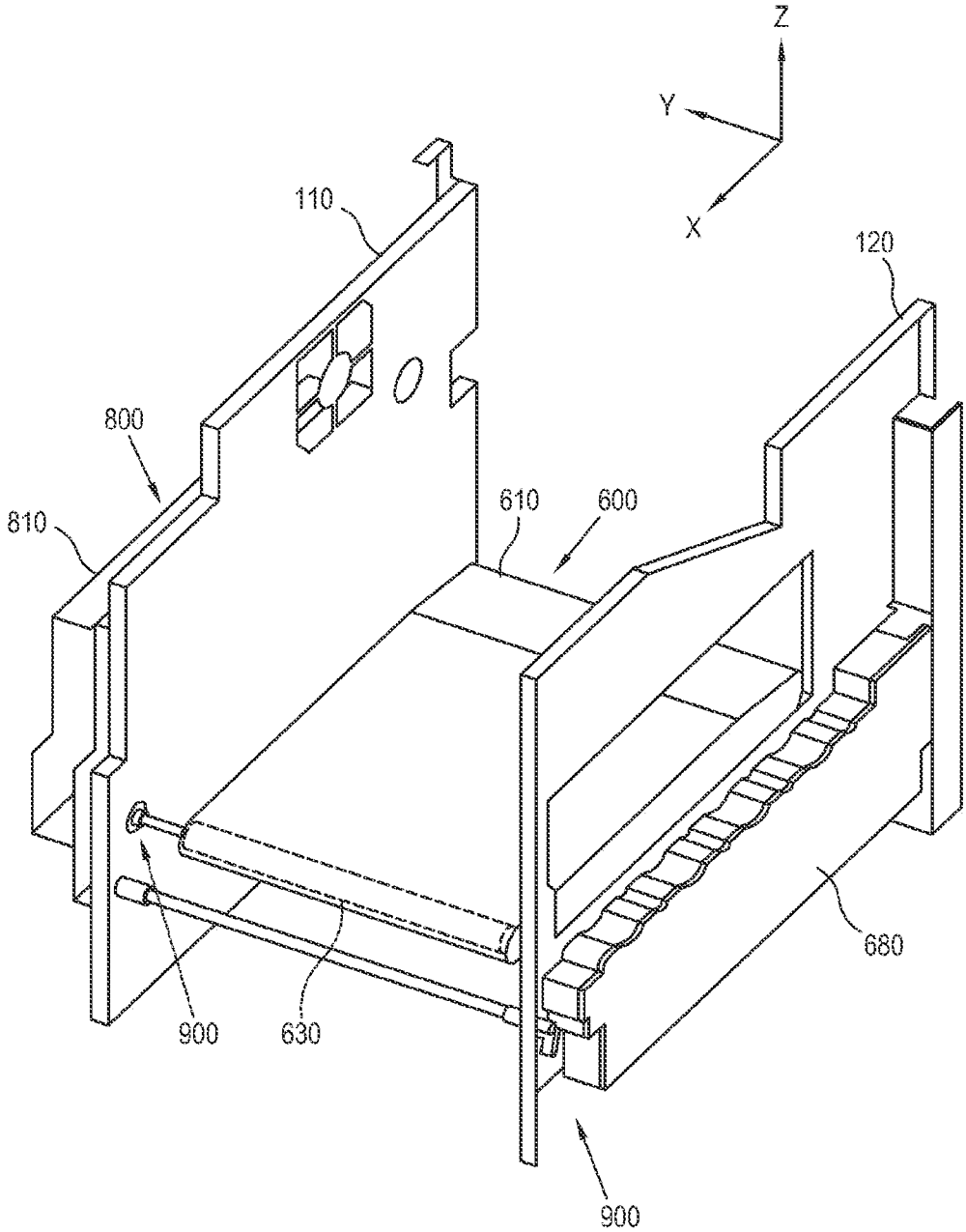
FIG. 2 is a perspective view illustrating an exemplary structure in which a transfer unit is mounted, per the present general inventive concept, in the image forming apparatus of FIG. 1.

An exemplary mounting structure by which the transfer unit 600 is mounted in the body housing 100 will now be described with reference to FIG. 2. FIG. 2 is a perspective view illustrating the transfer unit 600 mounted in the body housing 100. It is to be understood that certain components of the exemplary transfer unit 600 are omitted from FIG. 2 solely to avoid congesting the figure.

As illustrated in FIG. 2, the image forming apparatus 1 includes body frames 110 and 120 installed in the body housing 100 and respectively supporting both left and right sides of the transfer unit 600. The body frames 110 and 120 include a left frame 110 supporting the left side of the transfer unit 600 and a right frame 120 disposed in facing opposition with the left frame 110 and supporting the right side of the transfer unit 600. In the illustrated embodiment of FIG. 2, it is to be assumed that the transfer unit 600 is mounted in the X-Y plane between the left frame 110 and the right frame 120 so that each side is supported by a corresponding one of the left frame 110 and the right frame 120.

Additionally, the exemplary image forming apparatus 1 includes a driving unit 800 to generate a rotational driving force and a waste developing agent container 680 to store waste developing agent collected by the waste developing agent collecting unit 670. According to the present embodiment, the driving unit 800 is assembled on a surface of the left frame 110 in the Y direction, and the waste developing agent container 680 is attached to a surface of the right frame 120 in the −Y direction. Meanwhile, the transfer unit 600 is supported between a surface of the left frame 110 in the −Y direction and a surface of the right frame 120 in the Y direction.

The driving unit 800 includes a motor (not illustrated) to generate the rotational driving force and a plurality of driving force transfer gears (not illustrated) to transfer the rotational driving force from the motor (not illustrated) to components of the image forming apparatus 1 in a manner that establishes the relative motion between the components in accordance with the timing of the print cycle. The motor and the driving force transfer gears may be housed in a driving unit housing 810 attached to the surface of the left frame 110 in the Y direction. In particular, when the transfer unit 600 is mounted on the body frames 110 and 120, the driving unit 800 transfers the rotational driving force to the driving roller 630 which is then transferred to the intermediate transfer belt 610.

The exemplary waste developing agent container 680 is installed at one end portion of the waste developing agent collecting unit 670 and stores waste developing agent collected thereby. Once an amount of waste developing agent stored in the waste developing agent container 680 exceeds a predetermined level, a user detaches the waste developing agent container 680 from the right frame 120 to empty it and then reinstalls the emptied waste developing agent container 680. The exemplary image forming apparatus 1 includes an interlock detector (not illustrated) to sense whether the waste developing agent container 680 is installed, and prohibits printing operations when the interlock detector senses that the waste developing agent container 680 is not installed.

To accommodate the detaching of the transfer unit 600 from the body frames 110 and 120, the driving unit 800 is selectively engaged with or disengaged from the driving roller 630. Accordingly, while the driving roller 630 is disengaged from the driving unit 800, the transfer unit 600 is afforded free movement to be mounted on or separated from the body frames 110 and 120.

When the transfer unit 600 is properly mounted in the body frames 110 and 120, the driving roller 630 is rotated by the driving force from the driving unit 800. However, through error, such as by a user's inattentiveness, a printing process may be initiated while the driving unit 800 is not properly engaged with the driving roller 630 after the transfer unit 600 is reinstalled on the body frames 110 and 120. In this state, the driving roller 630 does not rotate and, accordingly, the intermediate transfer belt 610 remains stationary. However, the driving force from the motor (not illustrated) and the driving force transfer gears (not illustrated) may be applied to other components of the image forming apparatus 1, including the image holding members 300Y, 300M, 300C, and 300K. Consequently, not only is the final color image not properly formed on the recording medium (M), but also wear and tear occurs due to excessive friction between the image holding members 300Y, 300M, 300C, and 300K and the stationary intermediate transfer belt 610.

In certain embodiments of the present general inventive concept, the image forming apparatus 1 includes an engagement assembly 900 installed in the body frames 110 and 120 so as to selectively engage and disengage the driving unit 800 with the driving roller 630. In doing so, the engagement assembly 900 selectively allows or blocks the transfer of the driving force from the driving unit 800 to the driving roller 630. In certain embodiments of the present general inventive concept, the state of the engagement assembly 900, e.g., the allowing state or the blocking state, may also allow or block the installation of another component, such as the waste developing agent container 680, on the body frame 120.

In the exemplary embodiment described hereinafter, the engagement assembly 900 allows installation of the waste developing agent container 680 when the driving roller 630 is engaged with the driving unit 800 thereby, and blocks installation of the waste developing agent container 680 when the driving roller 630 is disengaged from the driving unit 800 thereby.

That is, the engagement assembly 900 prohibits the waste developing agent container 680 from being mounted in the body frames 110 and 120 while the driving force is prohibited from being transferred to the driving roller 630. Accordingly, due to the state of the interlock detector described above (not illustrated), a printing process cannot be carried out while the driving roller 630 is prevented from moving the intermediate transfer belt. Accordingly, excessive wear on the image holding members 300Y, 300M, 300C, and 300K and the transfer unit 600 is avoided and the resulting image on the recording medium (M) is of the expected quality.

The exemplary engagement assembly 900 is installed between the left frame 110 on which the waste developing agent container 680 is mounted and the right frame 120 on which the driving unit 800 is installed.

Figure 3:
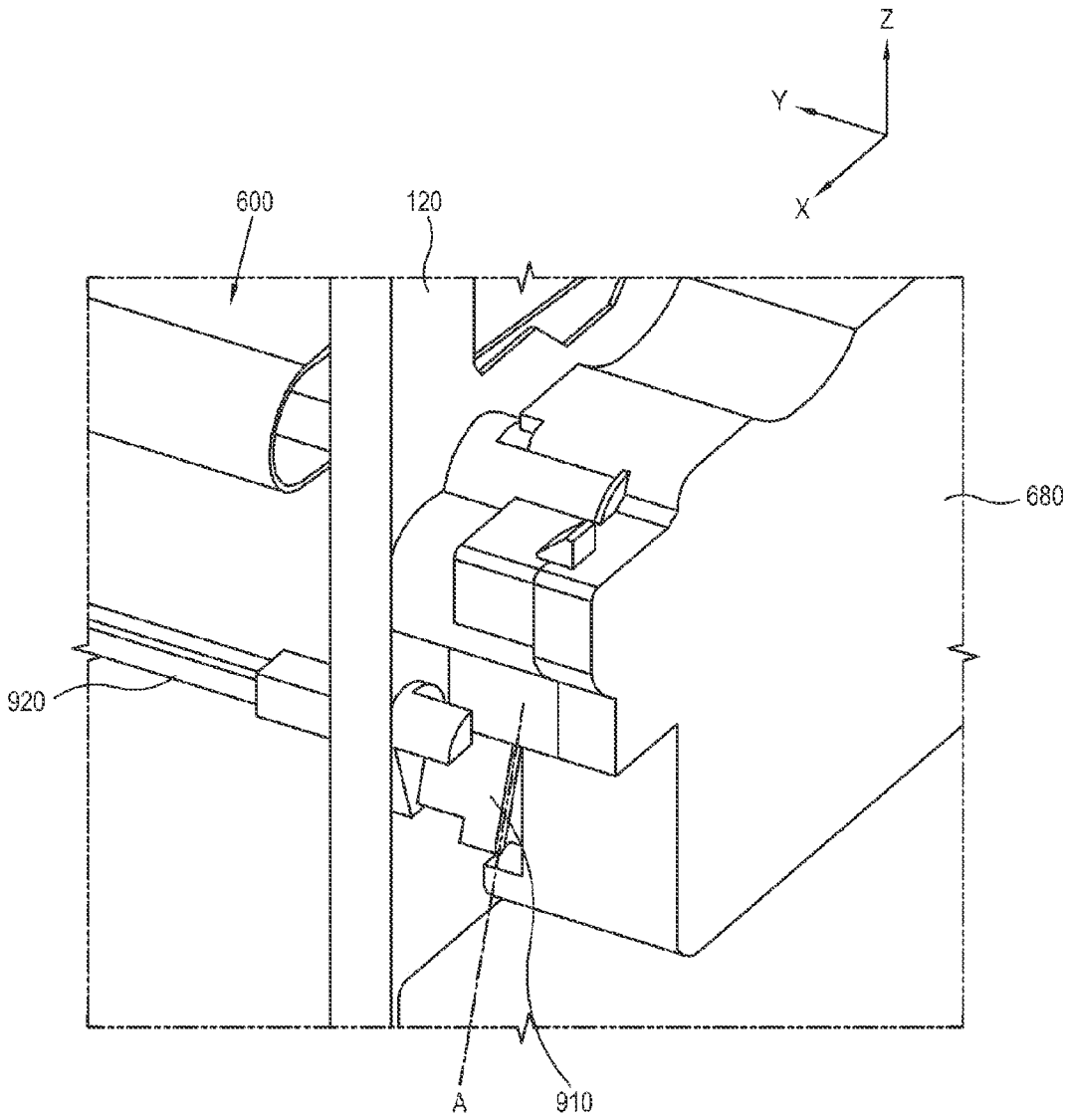
FIG. 3 is a perspective view illustrating an exemplary engagement assembly installed on a right frame, per the present general inventive concept, in an image forming apparatus of FIG. 2.

An exemplary configuration of the engagement assembly 900 will now be described in detail with reference to FIG. 3. FIG. 3 is a perspective view of the engagement assembly 900 installed on the right frame 120 in FIG. 2.

As illustrated in FIG. 3, the exemplary engagement assembly 900 includes a lever 910 extending from the right frame 120 and a link shaft 920 coupled to the lever 910 and rotatable thereby. The link shaft 920 extends from the lever 910, through the right frame 120 and the left frame 110, where it is linked to the driving unit 800, as described below.

The lever 910 may extend from the surface of the right frame 120 in the −Y direction where the waste developing agent container 680 is mounted. The lever 910 may be rotated by a user between predetermined angles, whereby it allows or blocks the mounting of the waste developing agent container 680. For example, the lever 910 does not obstruct a portion of the right frame 120 at which the waste developing agent container 680 is mounted when the lever 910 is at a predetermined allowing position (A). That is, when the lever 910 is positioned at the allowing position (A), the waste developing agent container 680 may be mounted on the right frame 120.

The link shaft 920 has one end portion installed on the rotational axis of the lever 910. The link shaft 920 thus rotates with the rotation of lever 910, by the same angle and in the same direction applied to the lever 910.

Figure 4:
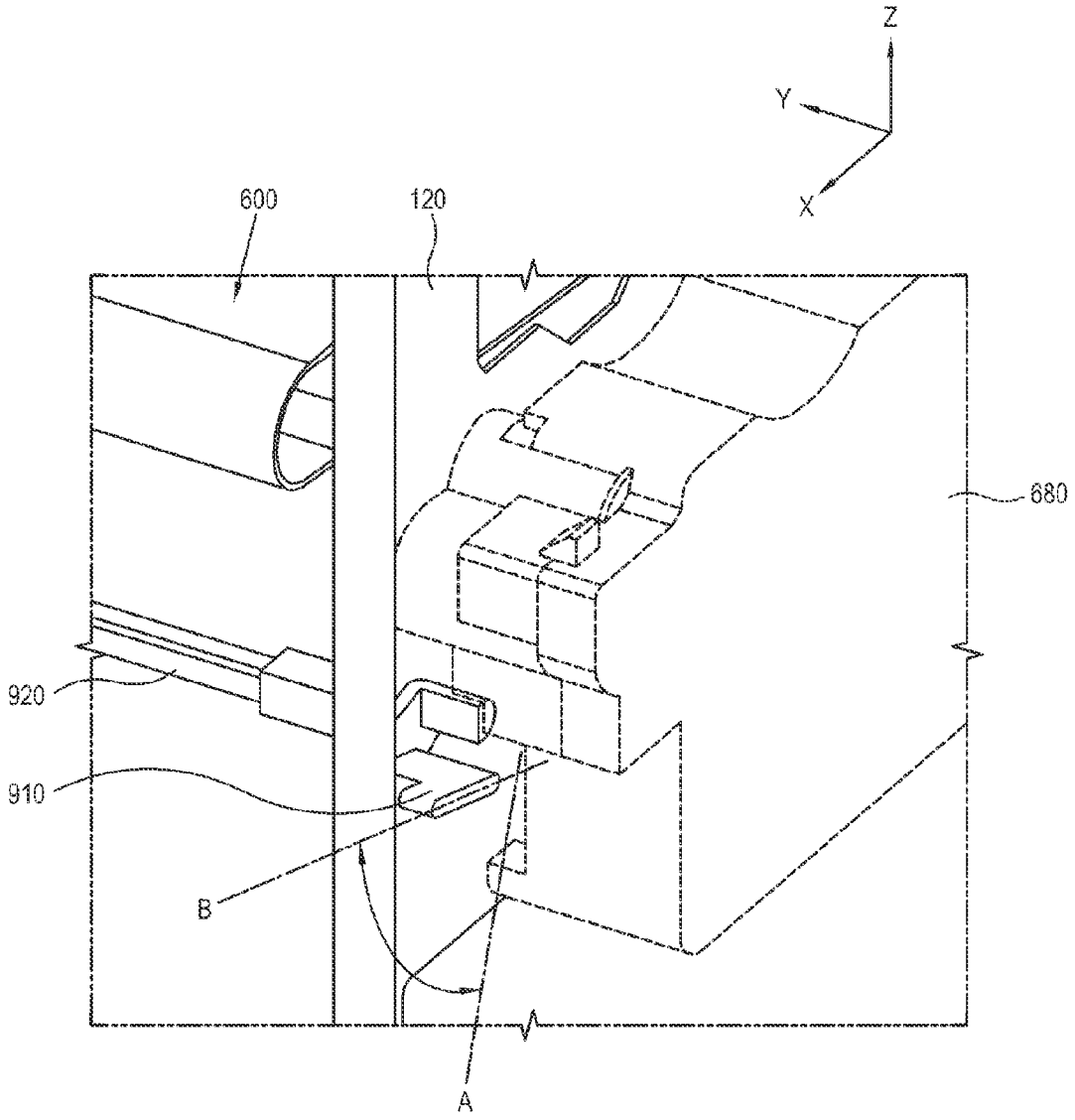
FIG. 4 is a perspective view illustrating an exemplary lever at a blocking position in the engagement assembly of FIG. 3 in accordance with the present general inventive concept.

FIG. 4 is a perspective view of the lever 910 as rotated to a blocking position (B).

As illustrated in FIG. 4, the lever 910 is rotated by a certain angle, for example, by a user, from the allowing position (A)

to the blocking position (B). The rotation of the lever 910 leads to rotation of the link shaft 920.

When the lever 910 is in the blocking position (B), a portion of the lever 910 is positioned in a region of the right frame 120 where the waste developing agent container 680 is normally mounted. Consequently, the waste developing agent container 680 is prohibited from being properly mounted on the right frame 120 due to the obstruction thereat by the lever 910 in the blocking position (B).

In short, a user may mount the waste developing agent container 680 on the right frame 120 only when the lever 910 is in the allowing position (A) and cannot mount the waste developing agent container 680 on the right frame 120 when the lever 910 is in the blocking position (B) owing to obstruction thereat by the lever 910.

Figure 5:
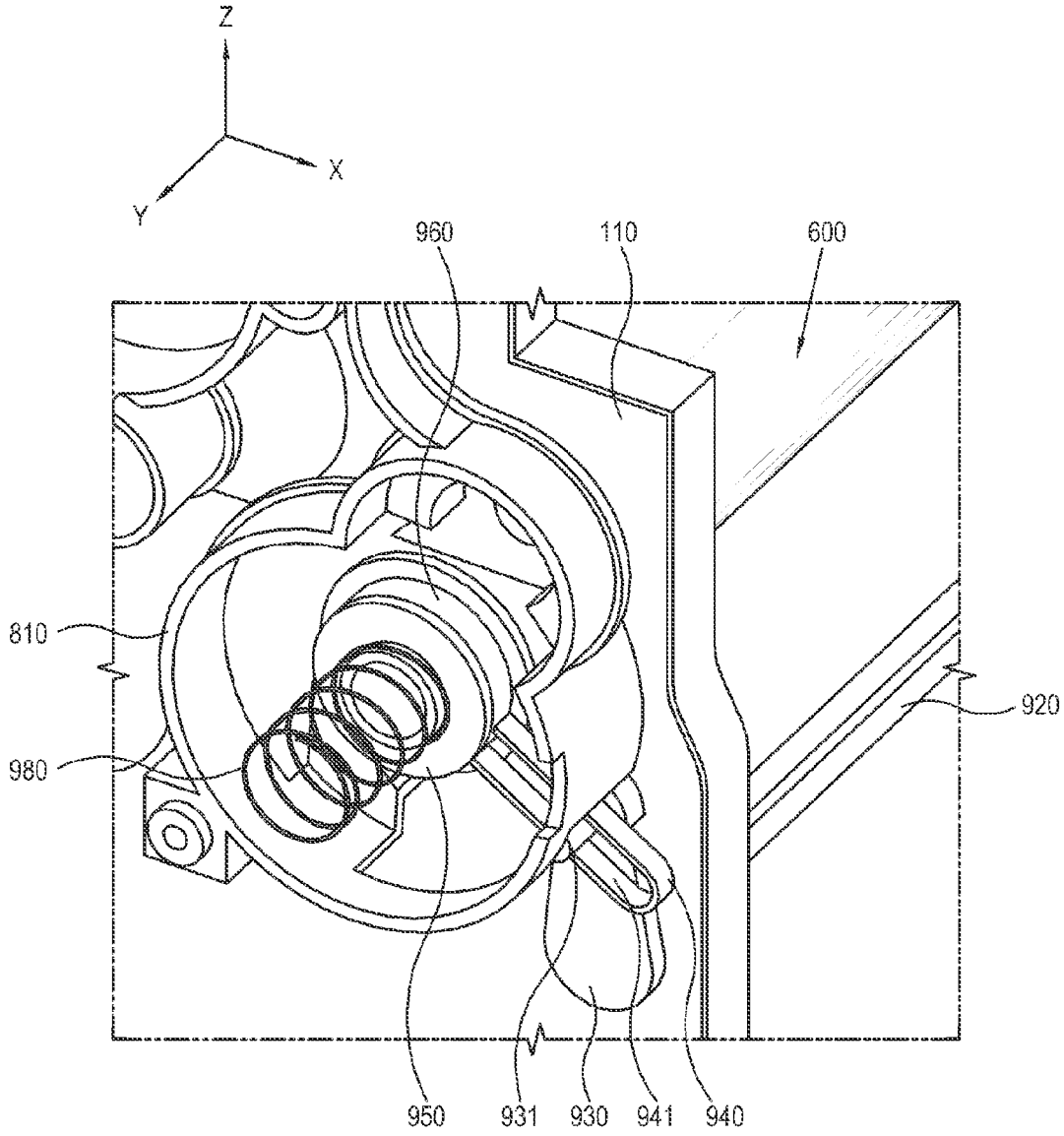
FIGS. 5 and 6 are perspective views illustrating an exemplary engagement assembly installed on the left frame being engaged with a driving roller, per the present general inventive concept, in the image forming apparatus of FIG. 2.
Figure 6:
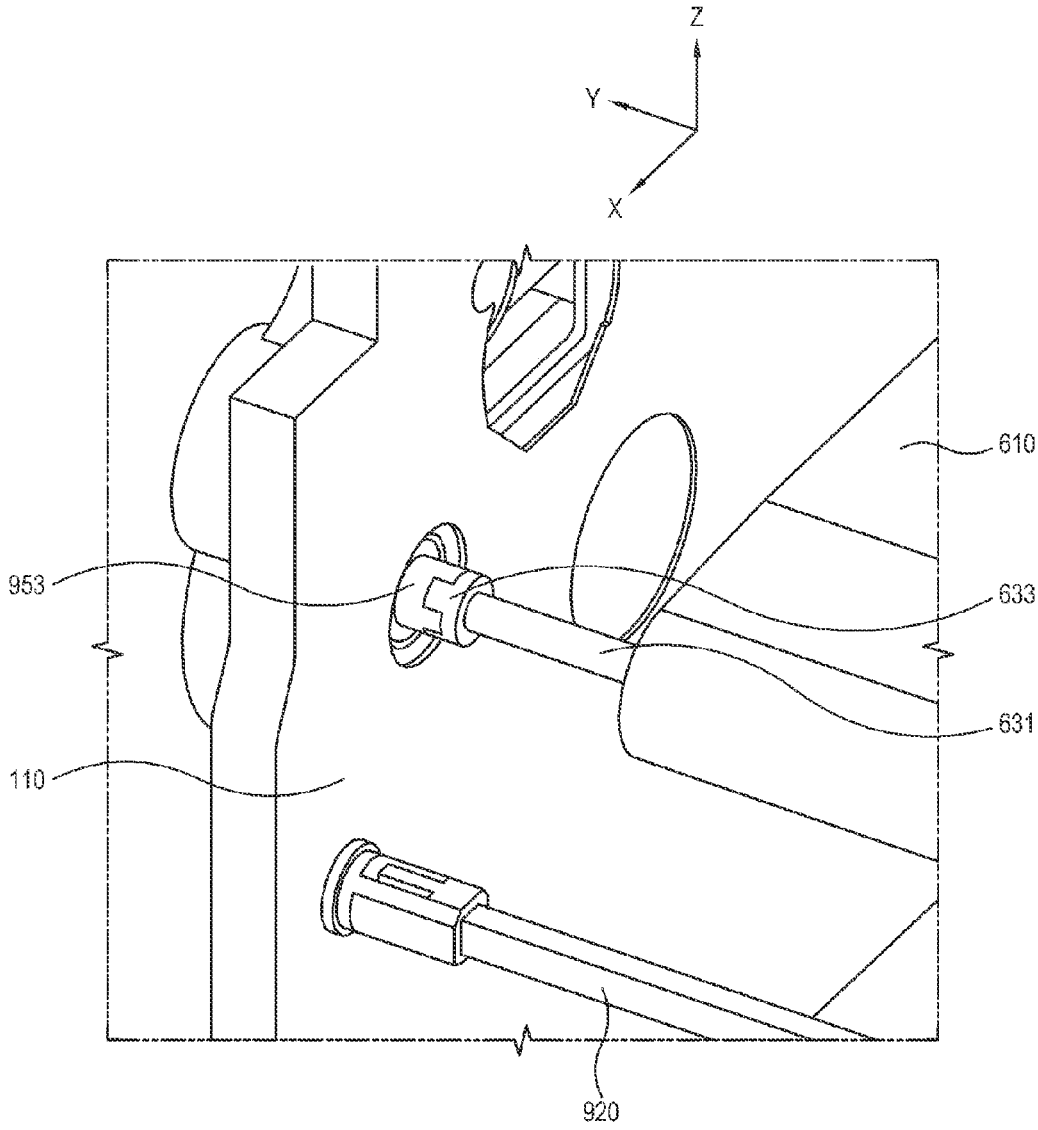

An exemplary configuration of the engagement assembly 900 installed on the left frame 110 will now be described in detail with reference to FIGS. 5 and 6. FIGS. 5 and 6 are perspective views illustrating the engagement assembly 900 installed on the left frame 100, as viewed from different directions. It is to be understood that certain components are omitted from FIG. 5 to avoid congesting the figure.

As illustrated in FIGS. 5 and 6, the exemplary engagement assembly 900 includes a first link 930 extending from the surface of the left frame 110 in the Y direction and a second link 940 engaging with an end portion of the first link 930 so as to be motivated thereby. A coupling member 950 passes through an opening in the left frame 110 so as to engage or disengage with the driving roller 630. A moving member 960 may be mechanically coupled to an end portion of the second link 940 as well as to the coupling member 950 to move the coupling member 950 by rotation of the second link 940. An elastic member 980 elastically biases the coupling member 950 toward the driving roller 630.

The first link 930 may be coupled to one end portion of the link shaft 920 extending through the left frame 110 so as to rotate with the rotation of the lever 910 about a rotation axis thereof. The first link 930 may have a supporting shaft 931 on a distal end thereof and extending therefrom in the Y direction. The supporting shaft 931 may be accommodated in a supporting shaft slot 941, by which the second link 940 engages with the first link 930.

In the presently described exemplary embodiment, the second link 940 is motivated by the first link 930 and has one end portion coupled to the moving member 960, whereby rotation of the first link 930 is transferred to the moving member 960. As the moving member 960 rotates, it is also moved linearly along the Y-axis by engagement with a protrusion 970, as will be described below.

The supporting shaft 931 is inserted into the supporting shaft slot 941, whereby the second link 940 is motivated by the first link 930. That is, when the first link 930 is rotated, the supporting shaft 931 applies force to the supporting shaft slot 941, which is transferred to the moving member 960.

The present exemplary embodiment has been described with the link shaft 920, the first link 930, and the second link 940 being interposed between the lever 910 and the moving member 960, but the present general inventive concept is not so limited. Various actuating mechanisms may be interposed between the moving member 960 and the lever 910 without departing from the spirit and intended scope of the present general inventive concept. That is, the correspondence of the movement of the moving member 960 with the movement of the lever 910 may be modified in accordance with applicable design parameters, such as the installation position of the lever 910, that of the moving member 960, the distance between the lever 910 and the moving member 960, etc.

The coupling member 950 extends through an opening in the left frame 110 and is movable over a predetermined range along the Y-axis. The coupling member 950 transfers a driving force applied thereto from the driving unit 800 to the driving roller 630 depending on the position of the lever 910.

A coupling member coupling part 953 may be disposed at one end portion of the coupling member 950 in the −Y direction to engage with a driving roller shaft 631 of the driving roller 630. A driving roller coupling part 633 may be disposed at one end portion of the driving roller shaft 631 and shaped complementary to that of the coupling member coupling part 953.

When the coupling member 950 is moved in the −Y direction, the coupling member coupling part 953 engages with the driving roller coupling part 633, whereby the driving roller 630 is rotated by the driving force of the driving unit 800. On the other hand, when the coupling member 950 is moved in the Y direction, the coupling member coupling part 953 disengages from the driving roller coupling part 633, whereby the transmission of the driving force from the driving unit 800 to the driving roller 630 is defeated.

The moving member 960 may be moved linearly by rotation of the second link 940, which linear motion is transferred to the coupling member 950 to be engaged with or disengaged from the driving roller 630. When the lever 910 rotates to the allowing position (A), the moving member 960 is moved so that the coupling member 950 is engaged with the driving roller 630, which is illustrated in FIGS. 5 and 6.

Figure 7:
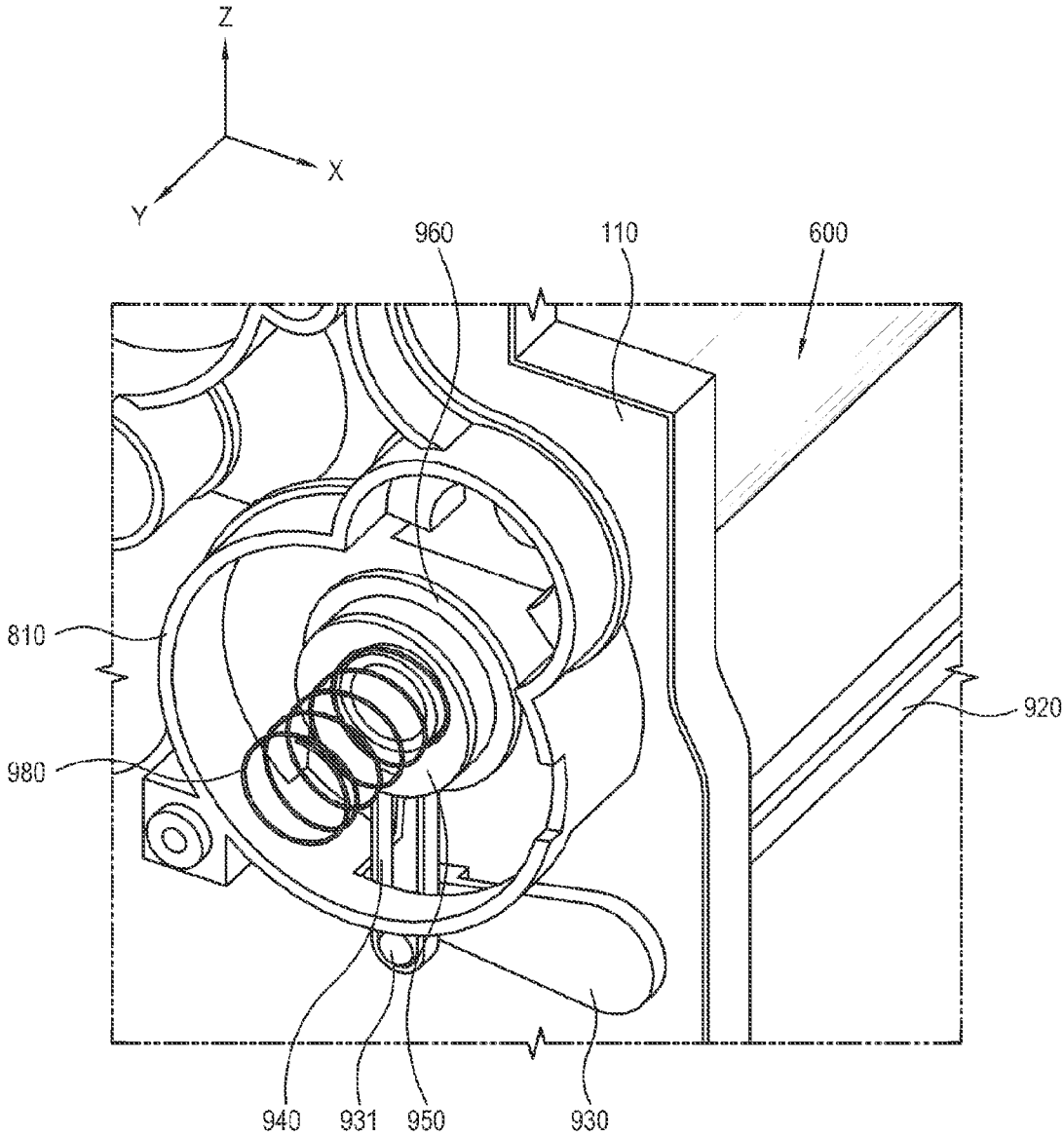
FIGS. 7 and 8 are perspective views illustrating the engagement assembly installed on the left frame being disengaged from the driving roller, per the present general inventive concept, in the image forming apparatus of FIG. 2.
Figure 8:
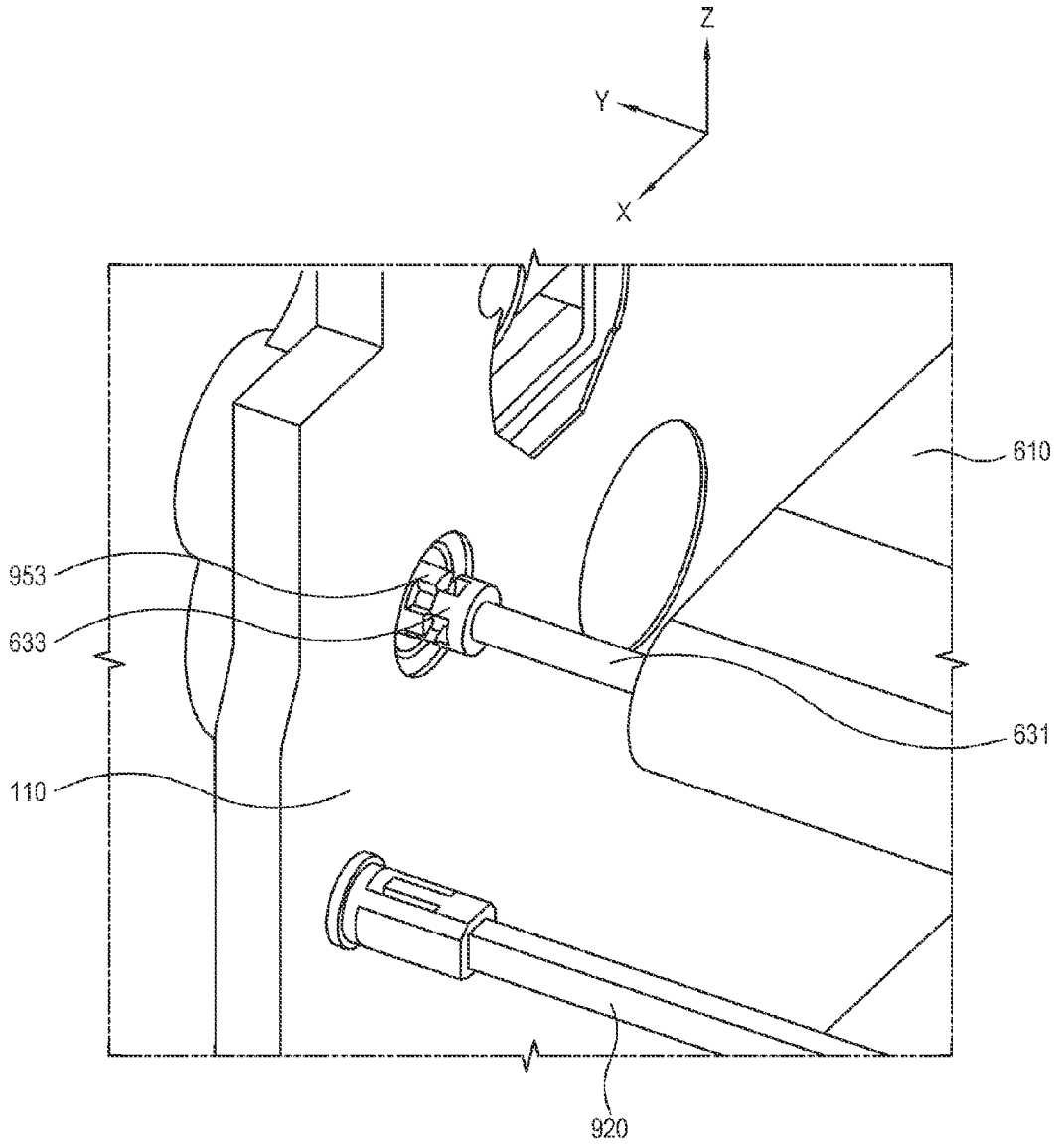

However, when the lever 910 rotates to the blocking position (B), the moving member 960 is moved so that the coupling member 950 is disengaged from the driving roller 630, which is illustrated in perspective views of FIGS. 7 and 8.

As illustrated in FIGS. 7 and 8, when the lever 910 rotates from the allowing position (A) to the blocking position (B), the first link 930 is also rotated. The second link 940 is rotated by engagement with the first link 930, and the moving member 960 is moved in the Y direction. An exemplary mechanism by which rotation of the second link 940 translates to movement of the moving member 960 is described below.

In the exemplary embodiment presently described, the moving member 960 motivates the coupling member 950 to be disengaged from the driving roller 630. Accordingly, the driving force of the driving unit 800 is not transferred to the driving roller 630. Further, since the coupling member is separated from the driving roller 630, the coupling member 950 does not interfere with detachment of the transfer unit 600 from the body frames 110 and 120 or with installation of the transfer unit 600 in the body frames 110 and 120.

Figure 9:
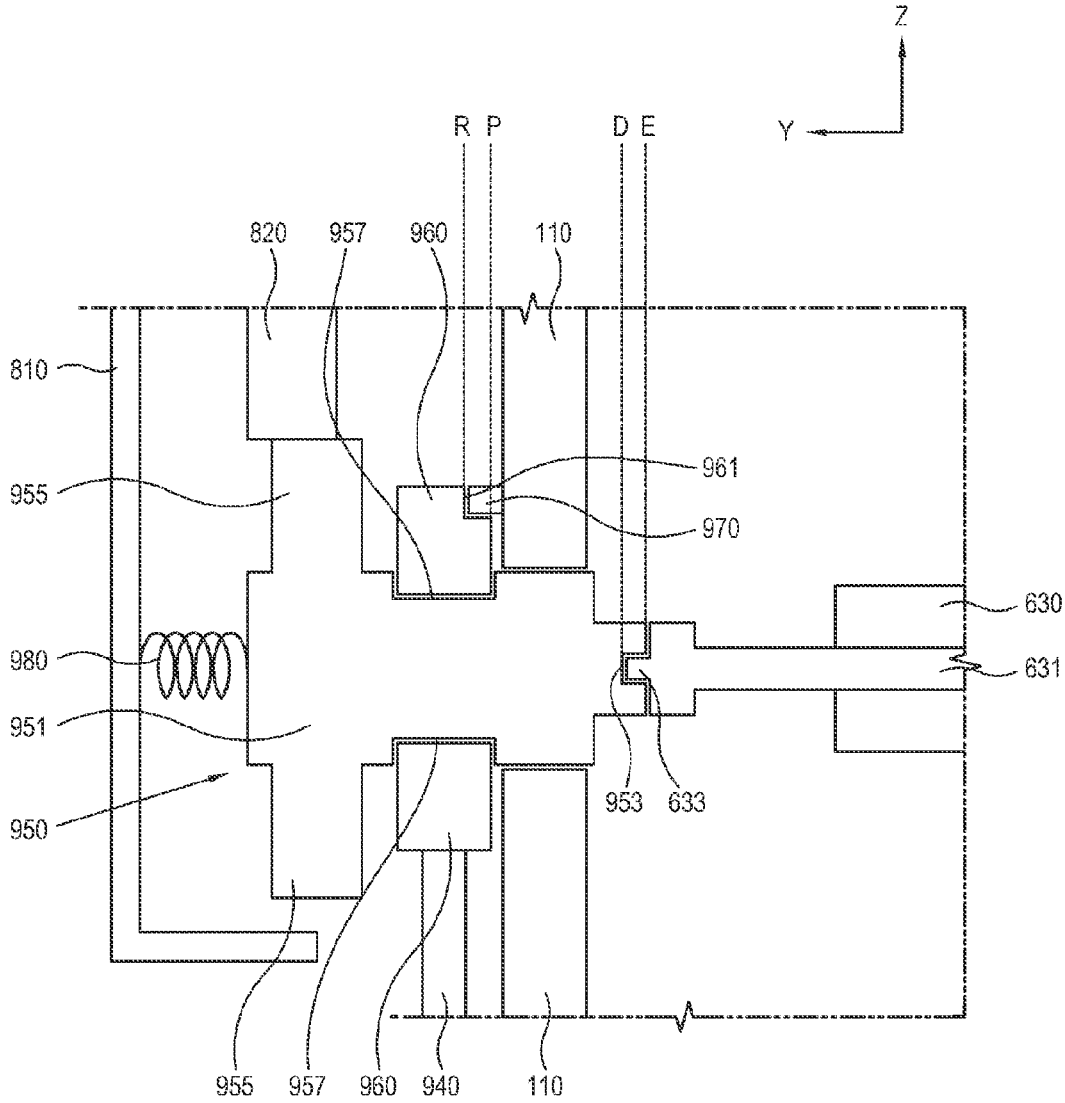
FIG. 9 is a lateral cross-sectional view illustrating a coupling member in an engaged state in the engagement assembly of FIG. 2 in accordance with the present general inventive concept.
Figure 10:
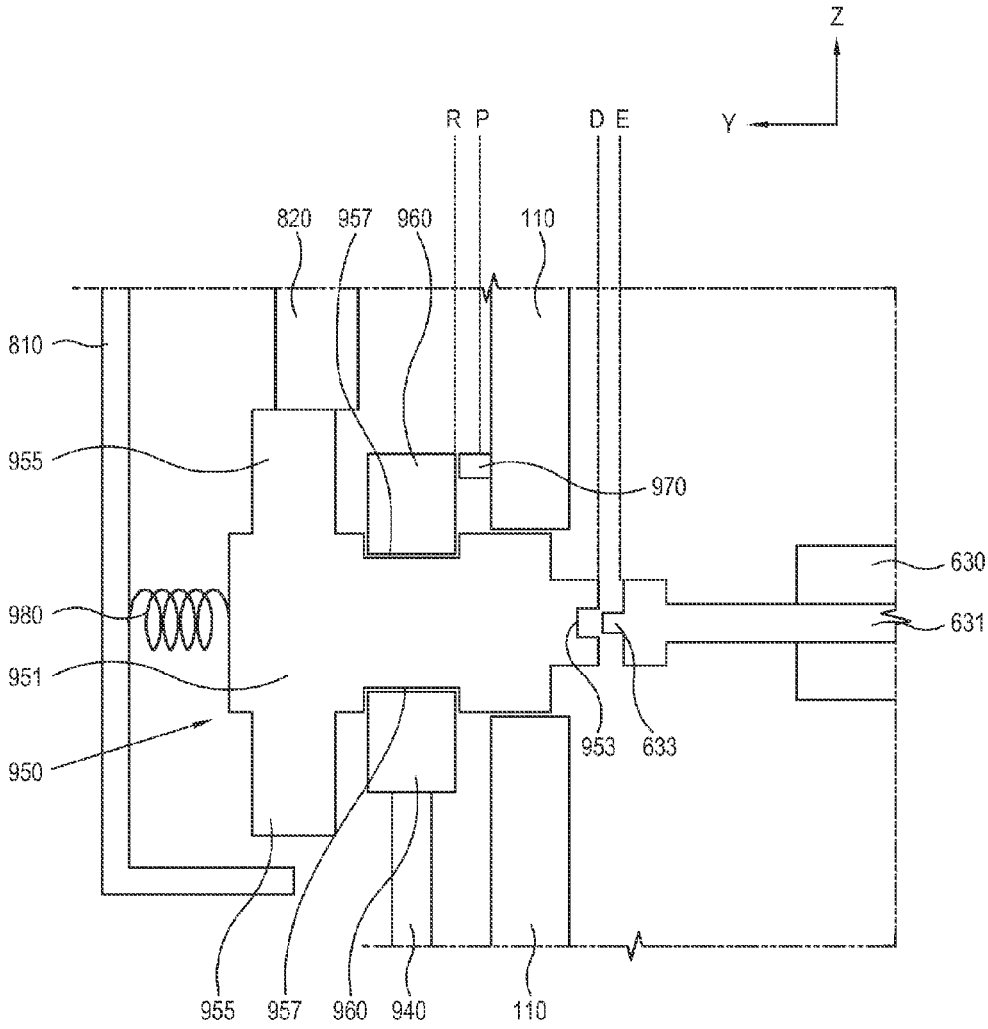
FIG. 10 is a lateral cross-sectional view illustrating the coupling member in a disengaged state in the engagement assembly of FIG. 9 in accordance with the present general inventive concept.

In the following, motion of the moving member 960 according to rotation of the lever 910 will be explained with reference to FIGS. 9 and 10. FIG. 9 is a lateral cross-sectional view illustrating the coupling member 950 in the engaged state of the engagement assembly 900. FIG. 10 is a lateral cross-sectional view illustrating the coupling member 950 in the disengaged state of the engagement assembly 900.

As illustrated in FIG. 9, the exemplary coupling member 950 includes a coupling member body 951 accommodated in the driving unit housing 810 and extending through the left frame 110, the coupling member coupling part 953 disposed on an end portion of the coupling member body 951 in the −Y direction, a coupling member gear 955 engaging with a driving force transfer gear 820 to transfer a driving force from the driving unit 800, and a moving member supporting part 957 supporting the moving member 960.

The exemplary coupling member 950 is rotated by the driving force transferred from the driving force transfer gear 820. The coupling member gear 955 may be attached to the coupling member body 951 or formed with the coupling member body 951 in a single body. As is illustrated in the FIG. 9, the coupling member 950 rotates freely in the moving member 960 and rotary power applied to the coupling member 950 is not transferred to the moving member 960.

The exemplary coupling member 950 moves between an engaging position (E), at which the coupling member coupling part 953 engages with the driving roller coupling part 633, and a disengaging position (D), at which the coupling member coupling part 953 disengages from the driving roller coupling part 633. Such movement of the coupling member 950 may be driven by the movement of the moving member 960 supported by the moving member supporting part 957.

In the exemplary embodiment illustrated in FIGS. 9 and 10, the moving member supporting part 957 is of a radius smaller than that of the other portions of the coupling member body 951 to accommodate the moving member 960; however other configurations are possible without departing from the spirit and intended scope of the present inventive concept.

The moving member 960 moves between a first position (P) and a second position (R) according to the position of the lever 910. When the moving member 960 is at the first position (P), the coupling member 950 is positioned at the engaging position (E) as illustrated in FIG. 9. When the moving member 960 is at the second position (R), the coupling member 950 is positioned at the disengaging position (D), as illustrated in FIG. 10.

The linear motion of the moving member 960 may be converted from rotation of the lever 910 by engagement thereof with the protrusion 970 formed on the surface of the left frame 110 in the Y direction. The moving member 960 may have an accommodation groove 961 formed on a surface thereof in the −Y direction to accommodate the protrusion 970.

When the lever 910 rotates to the allowing position (A) so that the waste developing agent container 680 can be mounted on the right frame 120, the moving member 960 rotates by the linking shaft 920 to a position at which the accommodation groove 961 accepts the protrusion 970. Here, the elastic member 980 elastically biases the coupling member 950 in the −Y direction, thereby contributing to movement of the moving member 960 to the first position (P).

As the moving member 960 translates to the first position (P), the coupling member 950 translates accordingly to the engaging position (E), whereby the coupling member coupling part 953 engages with the driving roller coupling part 633.

The driving force generated in the driving unit 800 is then transferred to the driving roller 630 through the driving force transfer gear 820, the coupling member gear 955, and the coupling member body 951. Accordingly, the driving roller 630 is driven to rotate.

Meanwhile, as illustrated in FIG. 10, when the lever 910 is rotated to the blocking position (B), thereby blocking the mounting position of the waste developing agent container 680, the moving member 960 rotates in accordance with the rotation of the linking shaft 920.

Here, the protrusion 970 leaves the accommodation groove 961 by the rotation of the moving member 960 and overcomes an elastic force of the elastic member 980 to space the surface of the moving member 960 in the −Y direction by a certain distance from the left frame 110. Accordingly, the moving member 960 translates to the second position (R). Here, at least one of the accommodation groove 961 and the protrusion 970 is formed in ramped fashion along a rotation direction of the moving member 960 so that the protrusion 970 is easily motivated out of the accommodation groove 961 when the moving member 960 rotates.

As the moving member 960 translates to the second position (R), the coupling member 950 moves to the disengaging position (D), whereby the coupling member coupling part 953 disengages from the driving roller coupling part 633. In certain embodiments of the present general inventive concept, the driving force transfer gear 820 remains engaged with the coupling member gear 955 throughout the range of movement of the coupling member 950.

When the coupling member coupling part 953 disengages from the driving roller coupling part 633, the driving force of the driving unit 800 is applied to the coupling member 950 but not to the driving roller 630. Further, as the coupling member 950 moves in the Y direction, the transfer unit 600 may be moved in the X direction or −X direction without interference from the coupling member 950.

Based on the aforementioned configuration, an exemplary process of assembling the transfer unit 600 in the body housing 100 according to the present embodiment will now be described.

For purposes of explanation and not limitation, an initial state is defined as a state in which the transfer unit 600 and the waste developing agent container 680 are detached from the body frames 110 and 120 and the coupling member 950 is at the disengaging position (D).

A user may mount the transfer unit 600 in the left frame 110 and the right frame 120 and rotate the lever 910 to the allowing position (A). As the lever 910 rotates, the link shaft 920 rotates (See FIG. 3).

Here, when the lever 910 is at the blocking position (B), the user may not mount the waste developing agent container 680 in the right frame 120 owing to interference by the position of the lever 910. Accordingly, the image forming apparatus 1 cannot perform a printing process in the state where the lever 910 is at the blocking position (B), since the interlock detector (not illustrated) will indicate to a processor or controller (not illustrated) that the waste developing agent container 680 is not installed (See FIG. 4).

Meanwhile, the first link 930 and the second link 940 are rotated by the rotation of the link shaft 920. The second link 940 rotates the moving member 960 by a certain angle and in a certain direction (See FIG. 5).

The rotation of the moving member 960 causes the accommodation groove 961 to accept the protrusion 970, and the moving member 960 moves to the first position (P) under the elastic bias of the elastic member 980. Accordingly, the coupling member 950 moves to the engaging position (E), and the coupling member 950 and the driving roller 630 engage with each other to enable the driving roller 630 to be driven (See FIG. 9).

Here, since the lever 910 is positioned at the allowing position (A), the user may mount the waste developing agent container 680 in the right frame 120 without interference of the lever 190.

An exemplary process of detaching the transfer unit 600 from the body frames 110 and 120 is as follows.

First, a user detaches the waste developing agent container 680 from the right frame 120 and moves the lever 910 to the blocking position (B). As the lever 190 is moved, the link shaft 920 rotates (See FIG. 4).

The first link 930 and the second link 940 are rotated by the rotation of the link shaft 920. The second link 940 rotates the moving member 960 by a certain angle and in a certain direction (See FIG. 7).

As the moving member 960 rotates, the protrusion 970 follows the ramped accommodation groove 961, for example, to space the moving member 960 from the left frame 110. The moving member 960 moves to the second position (R), and the coupling member 950 moves to the disengaging position (D). Accordingly, the coupling member 950 and the driving roller 630 disengage from each other, and the driving force from the driving unit 800 cannot be transferred. Here, the disengagement of the coupling member 950 causes the coupling member 950 to be spaced away from the driving roller 630 (See FIG. 10).

The user may detach the transfer unit 600 from the body frames 110 and 120. With the foregoing process, the transfer unit 600 is detached from the body frame 110 and 120.

In the embodiment described above, the driving unit 800 and the coupling member 950 are installed in the left frame 110, and the waste developing agent container 680 and the lever 910 are installed in the right frame 120. However, the present general inventive concept is not so limited.

As an example of a different configuration from that of the previously described embodiment, both the driving unit 800 and the waste developing agent container 680 may be installed in the left frame 110. In this case, the lever 910 may also be located on and extend from the left frame 110 to selectively block the waste developing agent container 680 from being mounted in the left frame 110 according to the rotation angle thereof.

Moreover, in such embodiment, since the lever 910 is installed in the left frame 110 along with the coupling member 950, the link shaft 920 may be omitted. Instead, the lever 910 may be assembled directly to the first link 930 to directly move the first link 930, or an additional linking component may be interposed between the lever 910 and the first link 930. The ordinarily skilled artisan will readily recognize numerous different configurations by which the moving member 960 and the coupling member 950 are motivated by the lever 910.

According to embodiments of the present general inventive concept, when the transfer unit is disengaged from the driving unit, the waste developing agent container is blocked from being mounted in the body frame by a simple structure, thereby preventing a printing process from proceeding in the state where the transfer unit is disengaged from the driving unit. Accordingly, the lifespan of the apparatus and image quality are not degraded.

Further, the waste developing agent container is allowed to be mounted only in the state where the driving roller of the transfer unit is engaged with the driving unit. In that the operation of the image forming apparatus is dependent on the state of the interlock detector of the waste developing agent container, excessive wear and tear due to excessive friction between the image holding members and the intermediate transfer belt can be prevented at the same time that contamination of the apparatus by scattering of waste developing agent which occurs when the waste developing agent container is not mounted can be prevented.

In addition, a user is allowed to easily select whether to engage the driving roller by the lever, so that the user can easily assemble the transfer unit and the body frame.

Upon review of the foregoing disclosure, the ordinarily skilled artisan will recognize other components to which an interlock device may be coupled and the mounting of which may be prohibited by the state of a transfer unit disengaging actuator. For example, the disengaging of the driving unit from the transfer unit may be achieve through a coupling similar to that described above that is actuated by the opening of the housing cover 102. The opening of the housing cover 102 may activate an interlock switch, for example, that prohibits the image forming apparatus from operating when the cover 102 is not closed.

Although a few exemplary embodiments have been illustrated and described, it will be appreciated by those skilled in the art that changes may be made to the foregoing exemplary embodiments without departing from the principles and spirit of the invention, the scope of which is defined in the appended claims and their equivalents.

What is claimed is:

1. An image forming apparatus comprising:

a body frame;

an image holding member supported by the body frame to receive a developing agent;

a transfer unit including a driving roller detachably supported by the body frame to transfer the developing agent on the image holding member to a recording medium;

a driving unit disposed on the body frame to provide a driving force to the transfer unit;

a waste developing agent container disposed on the body frame to store waste developing agent collected from the transfer unit; and an engagement assembly including a rotatable link shaft extending substantially parallel to the driving roller to selectively engage with the transfer unit to transfer the driving force from the driving unit to the transfer unit, the engagement assembly prohibiting or allowing installation of the waste developing agent container in the body frame in accordance with a state of engagement thereof with the transfer unit.

2. The image forming apparatus according to claim 1, wherein the engagement assembly allows the transfer of the driving force to the transfer unit and the installation of the waste developing agent container when engaging with the transfer unit, and blocks the transfer of the driving force to the transfer unit and the installation of the waste developing agent container when disengaging from the transfer unit.

3. The method according to claim 1, wherein the engagement assembly comprises a lever the manipulation of which motivates the engagement assembly to engage with or disengage from the transfer unit, the lever selectively extending into a portion of the body frame on which the waste developing agent container is mounted so as to block installation of the waste developing agent container when the engagement assembly is disengaged.

4. The image forming apparatus according to claim 3, wherein the engagement assembly comprises a coupling member operated by the lever between an engaging position at which the engagement assembly engages with the transfer unit supported by the body frame and a disengaging position at which the engagement assembly disengages from the transfer unit so as to allow removal of the transfer unit from the body frame.

5. The image forming apparatus according to claim 4, wherein the coupling member moves in a direction perpendicular to a surface of the body frame, and the transfer unit is detached from the body frame in a direction perpendicular to the direction in which the coupling member moves.

6. The image forming apparatus according to claim 4, wherein the body frame comprises a first body frame supporting one side of right and left sides of the transfer unit and on which the driving unit and the coupling member are installed, and a second body frame supporting the other side of the right and left sides of the transfer unit to face the first body frame and on which the waste developing agent container and the lever are installed.

7. The image forming apparatus according to claim 6, wherein the rotatable link shaft extends between the first body frame and the second body frame through which the coupling member is motivated by the lever.

8. The image forming apparatus according to claim 4, wherein the body frame comprises a first body frame and a second body frame supporting right and left sides of the transfer unit to face each other, respectively, and the driving unit is mounted to the first body frame and the waste developing agent container is mounted to the second body frame.

9. The image forming apparatus according to claim 4, wherein the engagement assembly comprises:

a moving member coupled to the coupling member so as to linearly move the coupling member by rotation of the moving member;

an accommodation groove formed on one side of the moving member toward the body frame;

and a protrusion interposed between the moving member and the body frame and engaging with the accommodation groove, the rotatable link shaft configured to rotate in accordance with the rotation of the lever, whereby the moving member translates the rotation of the link shaft to linear motion of the coupling member by which the coupling member moves between the engaging position and the disengaging position.

10. The image forming apparatus according to claim 9, wherein the engagement assembly further comprises an elastic member elastically biasing the coupling member towards the engaging position.

11. The image forming apparatus according to claim 1, wherein the transfer unit comprises:

an intermediate transfer belt in contact with the image holding member to receive a visible image from the image holding member;

an intermediate transfer roller installed in facing opposition to the image holding member with the intermediate transfer belt being interposed therebetween; and a final transfer roller to transfer the visible image transferred to the intermediate transfer belt to the recording medium, the driving roller being engaged with the engagement assembly to rotate the intermediate transfer belt by the driving force of the driving unit.

12. An image forming apparatus, comprising:

a waste developing agent container to inhibit a printing operation of the image forming apparatus if not properly positioned thereon;

a transfer unit including a driving roller to receive a developing agent defining a visible image and applying the received developing agent to a recording medium;

a driving unit to provide a driving force to the transfer unit by which the developing agent is conveyed to the recording medium; and an engagement unit including a rotatable link shaft extending substantially parallel to the driving roller to selectively engage the transfer unit with, and disengage the transfer unit from, the driving unit, the proper positioning of the waste developing agent container being prevented by the engagement unit when the transfer unit is disengaged from the driving unit.

13. The image forming apparatus according to claim 12, wherein the driving unit and the transfer unit include respective coupling members formed in physical complement one to the other and selectively coupled and separated through relative motion therebetween.

14. The image forming apparatus according to claim 13, wherein the engagement unit includes an actuator manually operable by a user to concurrently obstruct the positioning of the waste developing agent container to concurrently separate the coupling members from each other.

15. The image forming apparatus according to claim 14, wherein the actuator is operated by positioning the waste developing agent container in a position other than the proper position.

16. The image forming apparatus according to claim 15, wherein the waste developing agent container is an access unit through which the transfer unit is accessed.

17. The image forming apparatus according to claim 14, wherein the actuator is operated only after the waste developing agent container is positioned in a position other than the proper position.

18. An image forming apparatus, comprising:

a developing agent transferring unit comprising an intermediate transfer belt and a driving roller and defining an image forming path over which an electrostatic latent image is developed into a visible image;

a driving unit to drive the developing agent transferring unit in accordance with a predetermined timing of operations performed thereby over the image forming path;

an engagement unit including a rotatable link shaft extending substantially parallel to the driving roller to disengage the driving roller of the developing agent transfer unit from the driving unit so as to allow removal thereof from the image forming apparatus; and a waste developing agent container to inhibit performance of at least one of the operations when positioned in a position other than an operating position, the engagement unit being operable to disengage the developing agent transfer s unit from the driving unit only if the waste developing agent container is in a position other than the operating position.

19. The image forming apparatus according to claim 18, wherein the engagement unit prohibits positioning of the waste developing agent container into the operating position when the developing agent transferring unit is disengaged from the driving unit thereby.

20. The image forming apparatus according to claim 18, wherein the positioning of the waste developing agent container in a position other than the operating position inhibits performance of all of the operations.

21. The image forming apparatus according to claim 18, wherein the waste developing agent container is located external to the image forming path.

* * * * *